US007037242B2

(12) United States Patent
Lo et al.

(10) Patent No.: US 7,037,242 B2
(45) Date of Patent: May 2, 2006

(54) ANGLE ADJUSTABLE PEDALS FOR ELLIPTICAL EXERCISERS

(75) Inventors: Eric Lo, Tali (TW); Kuang-Shiung Kao, Taichung Hsien (TW); Joe Halfen, Andover, MN (US); Timothy Porth, Andover, MN (US)

(73) Assignee: Octane Fitness, LLC, Andover, MN (US)

( * ) Notice: Subject to any disclaimer, the term of this patent is extended or adjusted under 35 U.S.C. 154(b) by 394 days.

(21) Appl. No.: 10/611,971

(22) Filed: Jul. 3, 2003

(65) Prior Publication Data

US 2005/0003932 A1 Jan. 6, 2005

(51) Int. Cl.
*A63B 22/04* (2006.01)

(52) U.S. Cl. ..... 482/52; 482/62

(58) Field of Classification Search ..... 482/51–53, 482/57–65; 74/478.5, 512, 562.5
See application file for complete search history.

(56) References Cited

U.S. PATENT DOCUMENTS

| | | | | |
|---|---|---|---|---|
| 5,690,589 | A * | 11/1997 | Rodgers, Jr. | 482/57 |
| 6,170,355 | B1 * | 1/2001 | Fay, III | 74/512 |
| 6,500,096 | B1 * | 12/2002 | Farney | 482/52 |
| 6,719,665 | B1 * | 4/2004 | Lai | 482/52 |

* cited by examiner

*Primary Examiner*—Stephen R. Crow
*Assistant Examiner*—Tam Nguyen
(74) *Attorney, Agent, or Firm*—Bacon & Thomas, PLLC

(57) ABSTRACT

An angle adjustable pedal assembly for elliptical exercisers includes a pedal frame and a pedal which is pivotably connected to two sides on an end of the pedal frame. Each side wall has a hole with three notches defined in an inside of the hole and the pedal has two connection plates each of which has a reset slot and a set slot which communicates with the reset slot. A pin extends through one of the reset slot and the set slot, and is engaged with one of the three notches in the side walls so that the pedal can be set at different angle relative to the pedal frame by engaging with one of the three notches in the side walls.

1 Claim, 11 Drawing Sheets

ANGLE ADJUSTABLE PEDALS FOR ELLIPTICAL EXERCISERS

FIELD OF THE INVENTION

The present invention relates to an elliptical exerciser having two pedals which are angle adjustable so as to meet different requirements of the users.

BACKGROUND OF THE INVENTION

A conventional elliptical exerciser 10 is disclosed in FIG. 1 and generally includes a frame 11 and a wheel 12 is connected thereto, a crank 13 is connected to the wheel so that a user may hold the handle 15 and step on the pedals 161 on the pedal frame 16 to operate the exerciser. A connection bar 14 is pivotably connected to an end of the crank 13 and the other end of the connection bar 14 is connected to the handles 15. One end of the connection bar 14 is pivotably connected to an end of the pedal frames 16 and the other end of the connection bar 14 is pivotably connected to a link which is pivotably connected to the frame 11. The user holds and swings the handles 15 while the feet alternatively operate the pedals 161 in an elliptical trace. The pedal frames 16 each have a roller 162 which rolls on a rail 17 on the ground. The rails 17 can be raised at an angle relative to the ground so as to adjust the exercising levels to meet different requirements of the users. Nevertheless, as disclosed in FIG. 2, the pedals 161 and the pedal frames 16 are made as a one-piece so that the pedals cannot be adjusted according to the change of the rails 17.

The present invention intends to provide angle adjustable pedals for elliptical exercisers wherein the pedals can be adjusted relative to the pedal frames.

SUMMARY OF THE INVENTION

In accordance with one aspect of the present invention, there is provided a pedal assembly for an elliptical exerciser and the pedal assembly includes a pedal frame having a first end pivotably connected to connection bars connected to the crank on the wheel, and a second end of the pedal frame has two side walls. An end plate is connected between the two side walls and each side wall has a hole and three notches are defined in an inside of the hole. A roller is connected to the pedal frame and movably engaged to the rail.

A pedal has two connection plates which are pivotably connected to the two side walls of the pedal frame. Each connection plate has a set slot and a reset slot defined therethrough. The set slot and the reset slot communicate with each other and an angle is defined between two axes of the set slot and the reset slot. A pin extends through one of the set slot and the reset slot and the hole. A bolt extends through the end plate and is fixedly connected to a mediate portion of the pin. A spring is mounted to the bolt and biased between the pin and the end plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
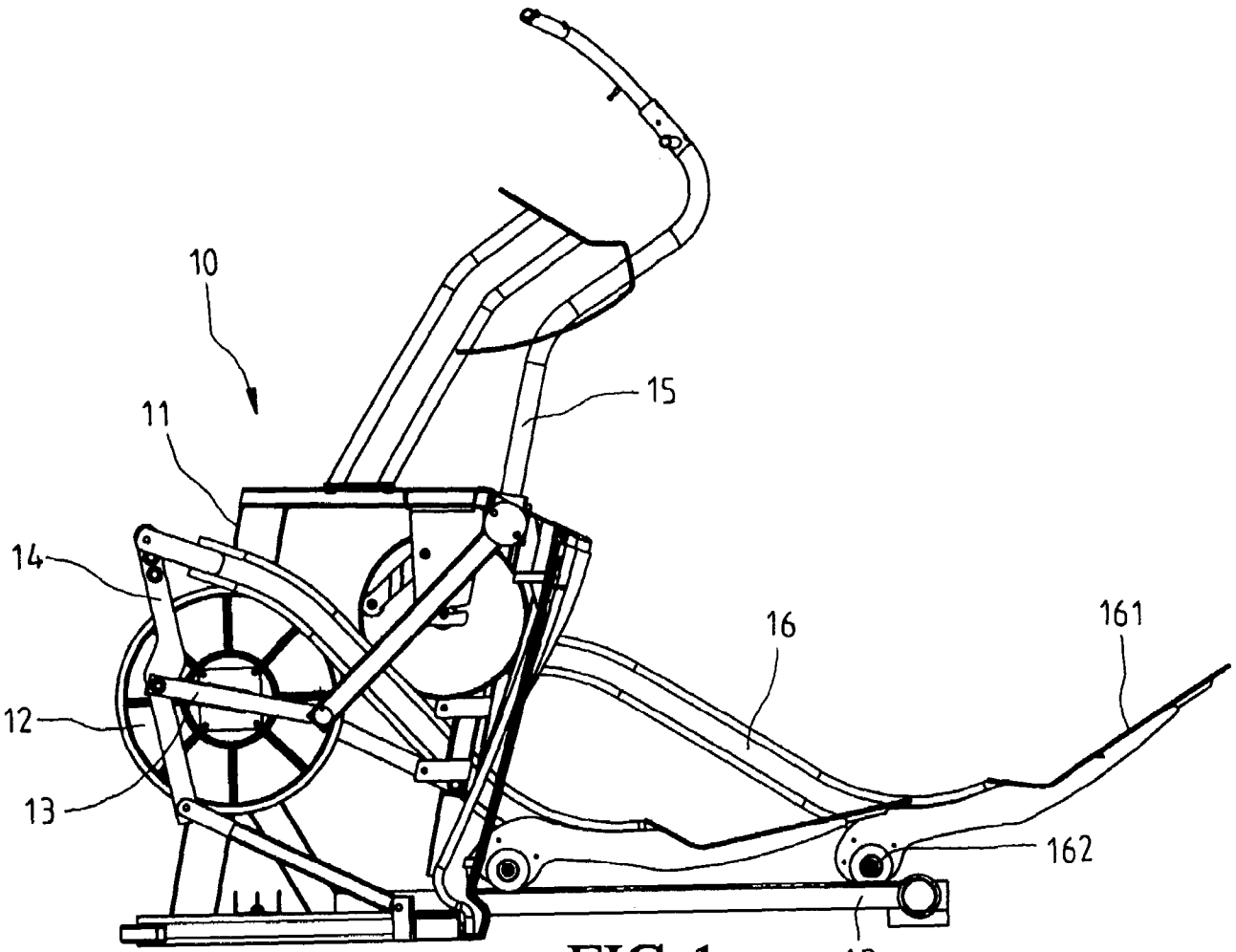
FIG.1 PRIOR ART
FIG. 1 shows a conventional elliptical exerciser.
Figure 2:
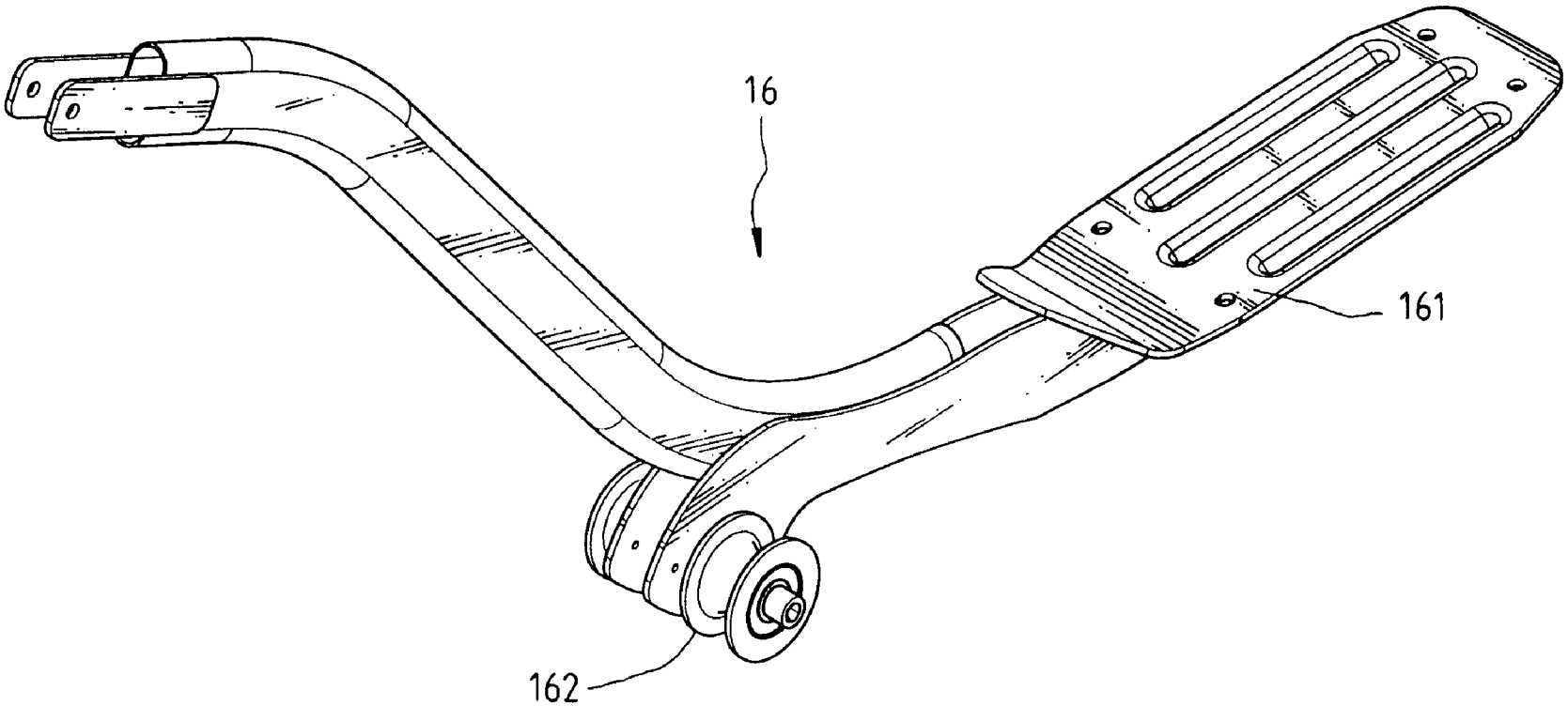
FIG.2 PRIOR ART
FIG. 2 is a perspective view of the pedal of the conventional elliptical exerciser.
Figure 3:
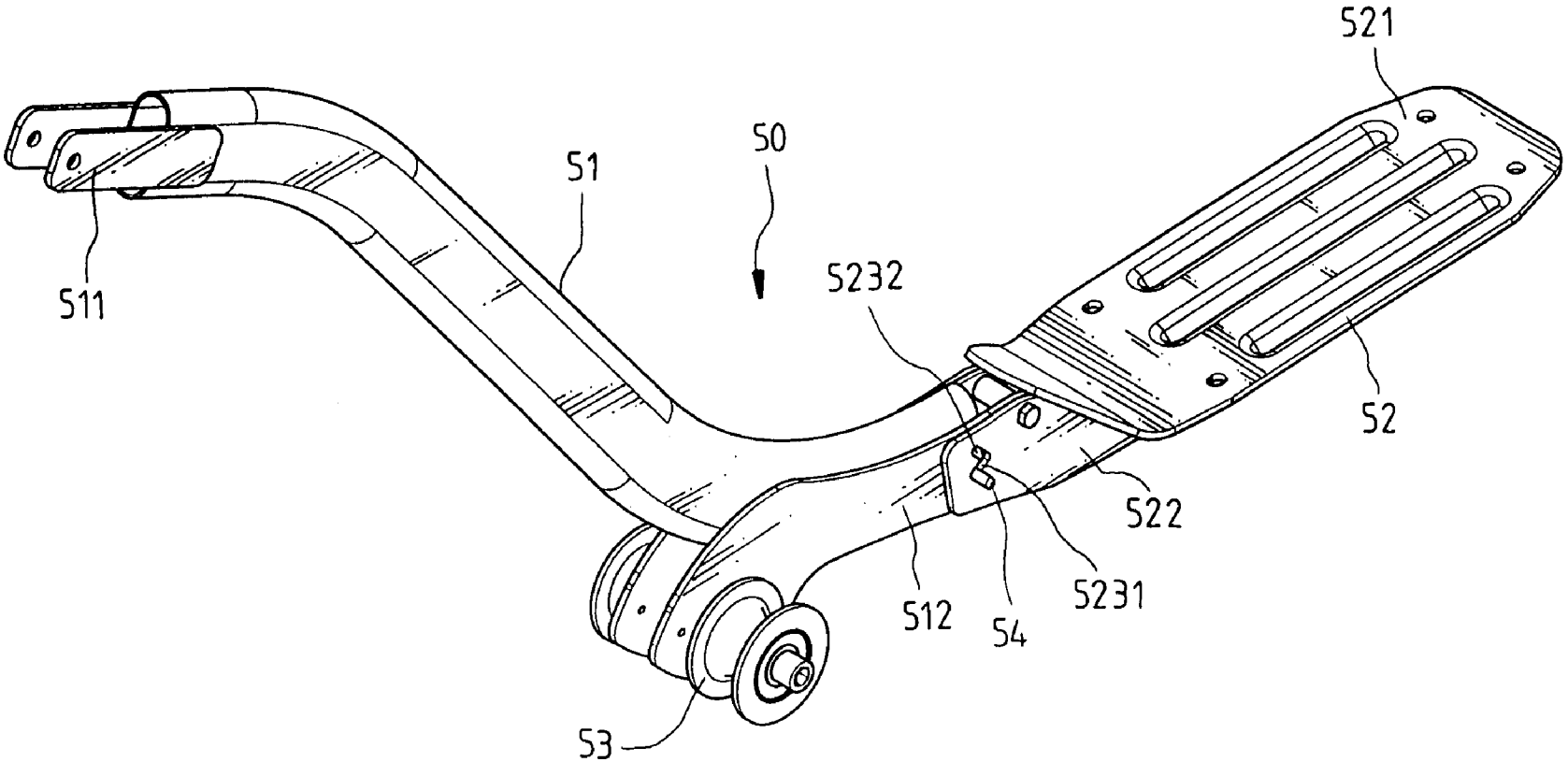
FIG. 3 is a perspective view of the pedal assembly of the present invention.
Figure 4:
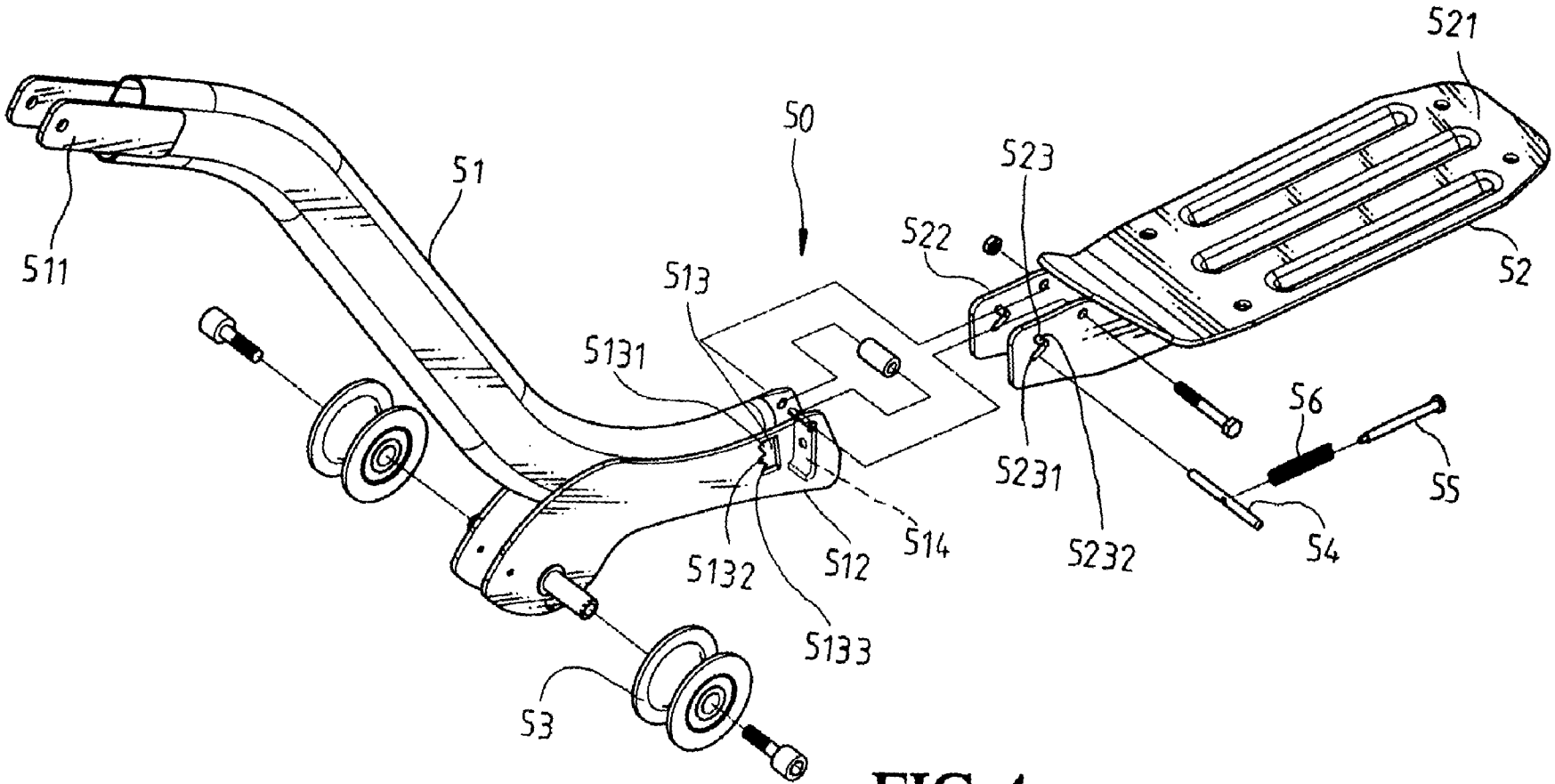
FIG. 4 is an exploded view to show the pedal assembly of the present invention.

Referring to FIGS. 3 to 6, the elliptical exerciser of the present invention comprises a frame 20 having a wheel 30 connected thereto and a crank 310 (FIG. 5) is connected to the wheel 30. Each one of two ends of the crank 310 has an extension link 31 and the extension links 31 are located on two sides of the wheel 30. A mediate portion of a connection bar 32 is pivotably connected to an end of each of the extension links 31 and the other end of each of the extension link 31 is connected to an end of a handle 40. An end of each of the connection bars 32 is pivotably connected to a link 200 (FIG. 5) which is pivotably connected to the frame 20. Two rails 60 each have an end pivotably connected to the frame 20 and the other end of each of the rails 60 connected to a lifting device 70 which is a hydraulic cylinder so that the rails 60 can be raised by operating the hydraulic cylinders.

Two pedal assemblies 50 each comprise a pedal frame 51 having two lugs 511 on a first end thereof which is pivotably connected to the other end of each of the connection bars 32. A second end of the pedal frame 51 has two side walls 512 and an end plate 514 is connected between the two side walls 512. Each side wall 512 has a hole 513 and three notches 5131, 5132, 5133 are defined in an inside of the hole 513. Two rollers 53 are connected to each pedal frame 51 and movably engaged to the rail 60.

A pedal 52 has two connection plates 522 which are pivotably connected to the two side walls 512. Each connection plate 522 has hole 523 which is composed of a set slot 5231 and a reset slot 5232. The set slot 5231 and the reset slot 5232 communicate with each other and a angle is defined between two axes of the set slot 5231 and the reset slot 5232.

A pin 54 extends through one of the set slot 5231 and the reset slot 5232 and the hole 513. A bolt 55 extends through the end plate 514 and is fixedly connected to a mediate portion of the pin 54. A spring 56 is mounted to the bolt 55 and biased between the pin 54 and the end plate 514.

Figure 5:
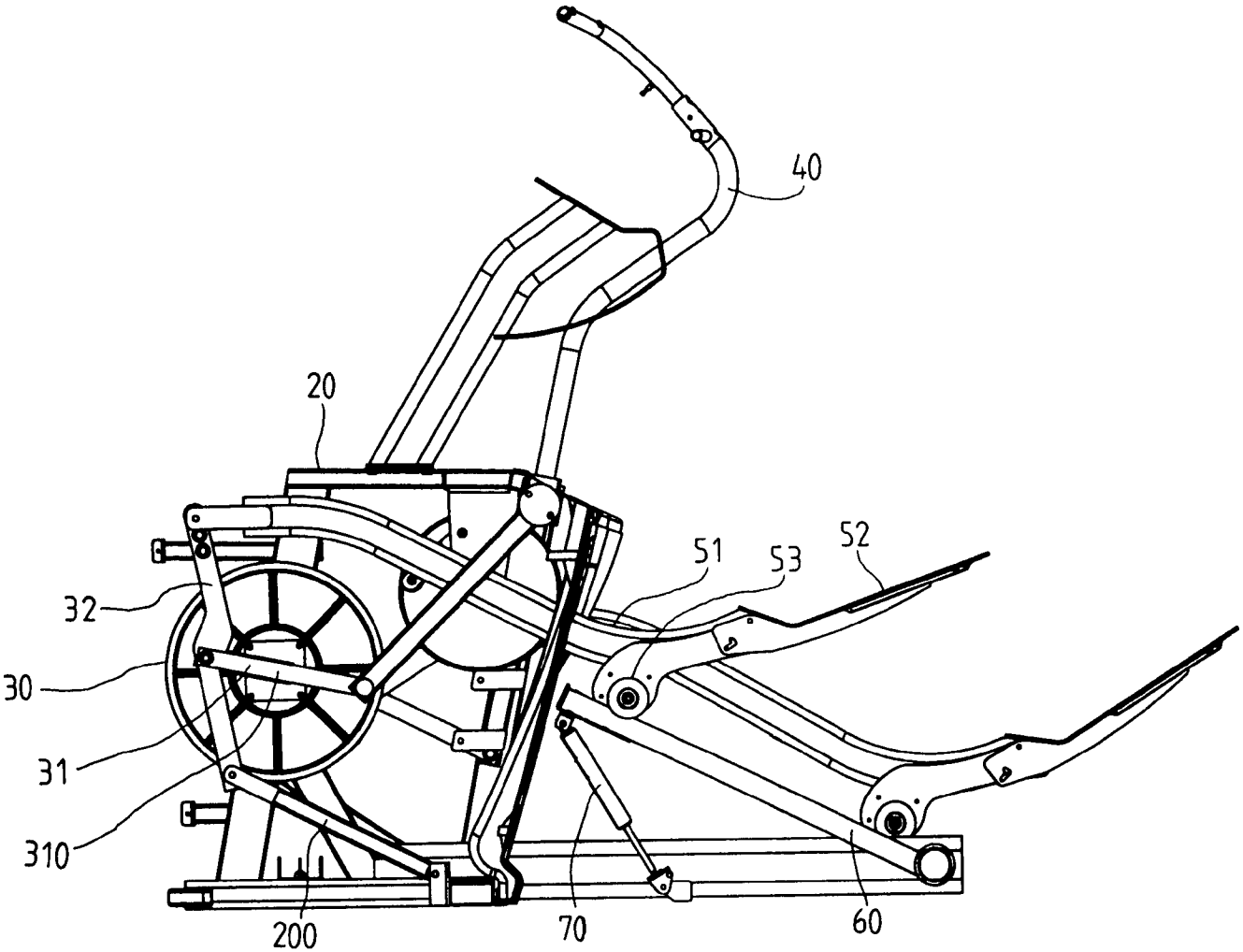
FIG. 5 is shows the elliptical exerciser with the pedal assembly of the present invention.
Figure 6:
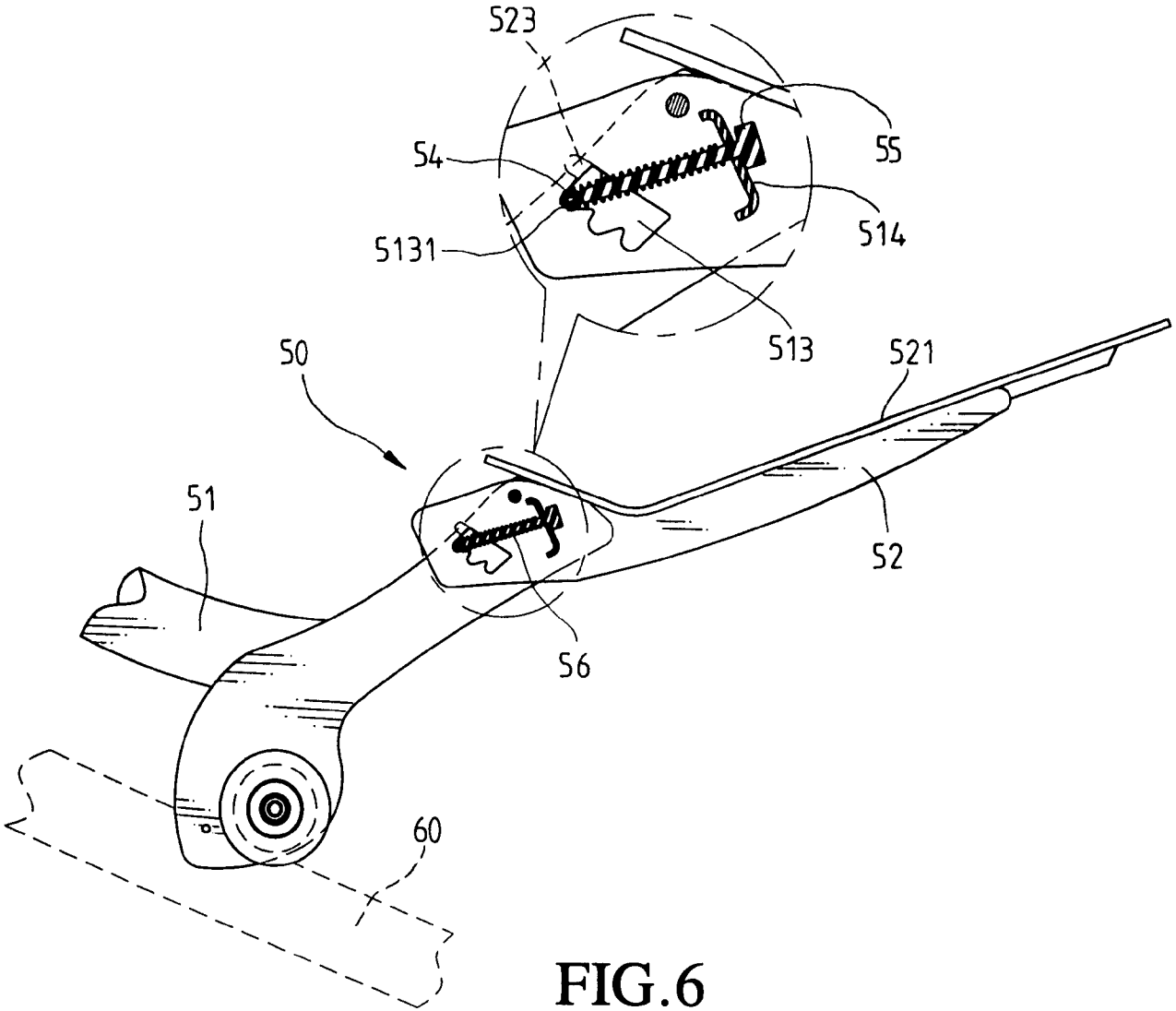
FIG. 6 shows the pin is engaged with the first notch in the hole of the pedal frame when the rails are positioned at the first position as shown in FIG. 5.
Figure 7:
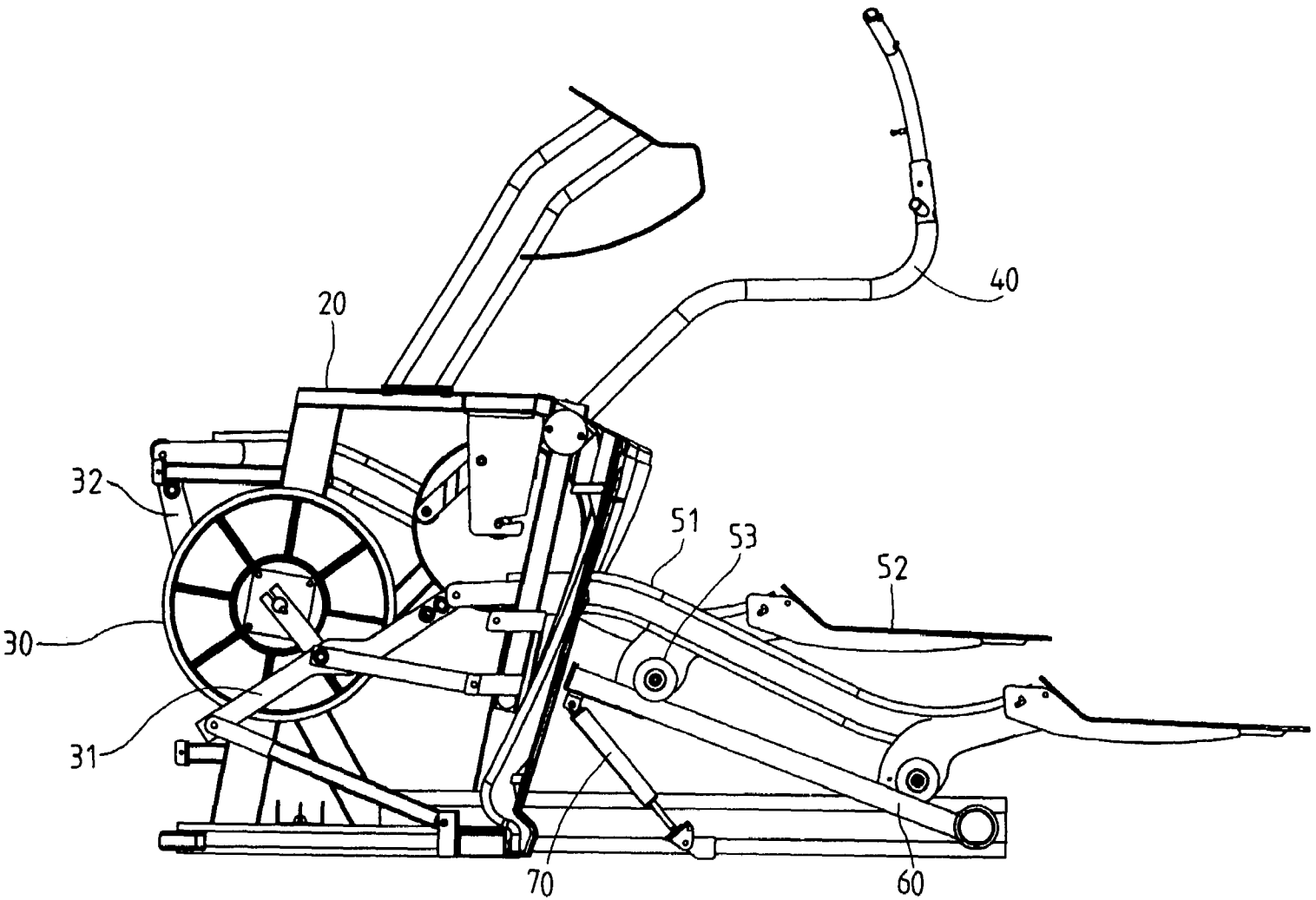
FIG. 7 is shows the elliptical exerciser with the pedal assembly of the present invention.
Figure 8:
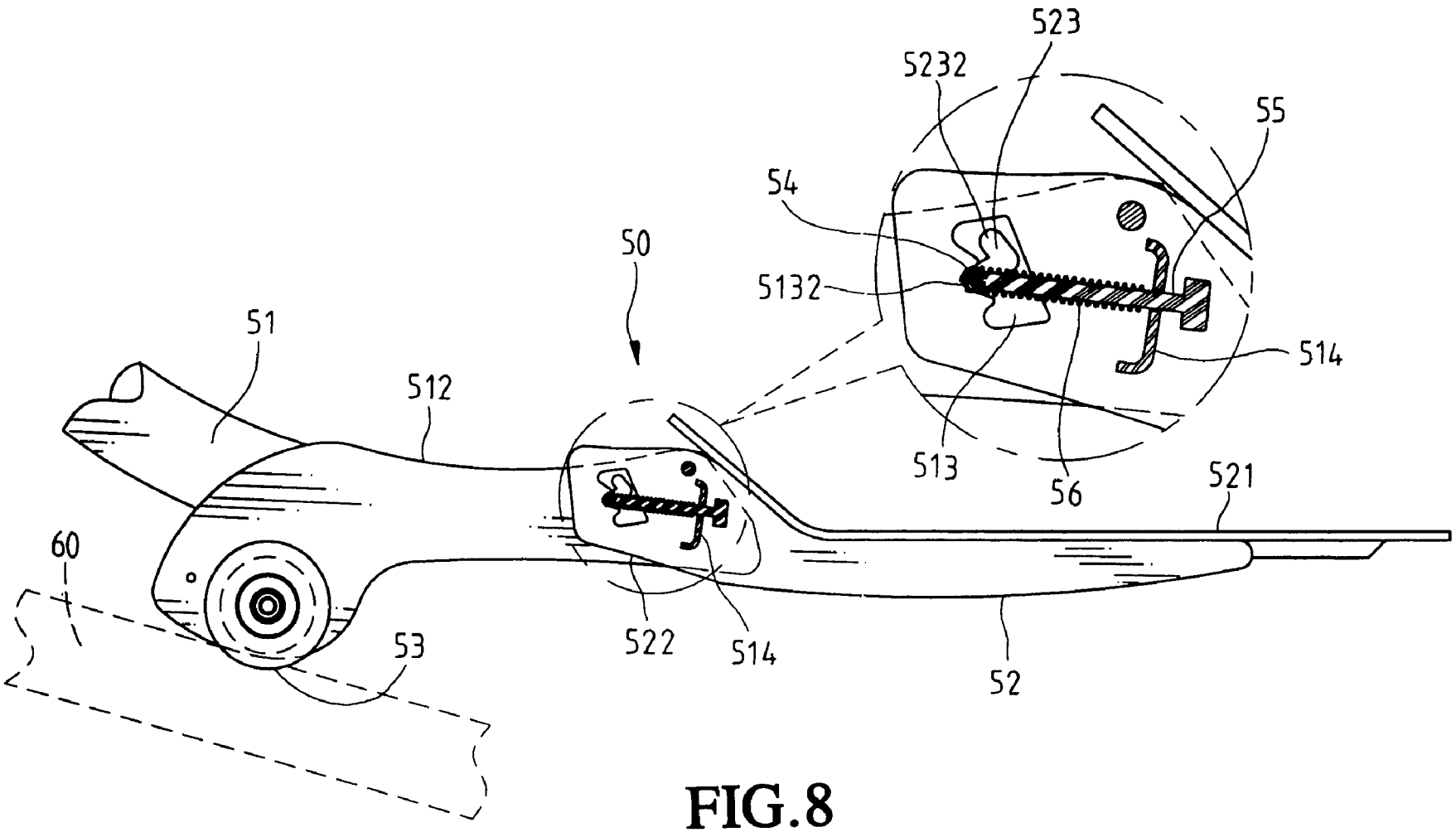
FIG. 8 shows the pin is engaged with the second notch in the hole of the pedal frame when the rails are positioned at the second position as shown in FIG. 6.

The rails 60 is raised to its highest position in FIG. 5 and the pin 54 is located in the set slot 5231 and engaged with the first notch 5131. When the rails 60 are to be lowered to the position as shown in FIGS. 7 and 8, the user simply pushes the pedal 52 counter clockwise and the pin 54 is pulled by a periphery of the set slot 5231 and is disengaged from the first notch 5131. The pin 54 is then slid into the second notch 5132 by the spring 56. By this way, the pedal 52 is pivoted toward horizontal direction and the convenient for the user.

Figure 9:
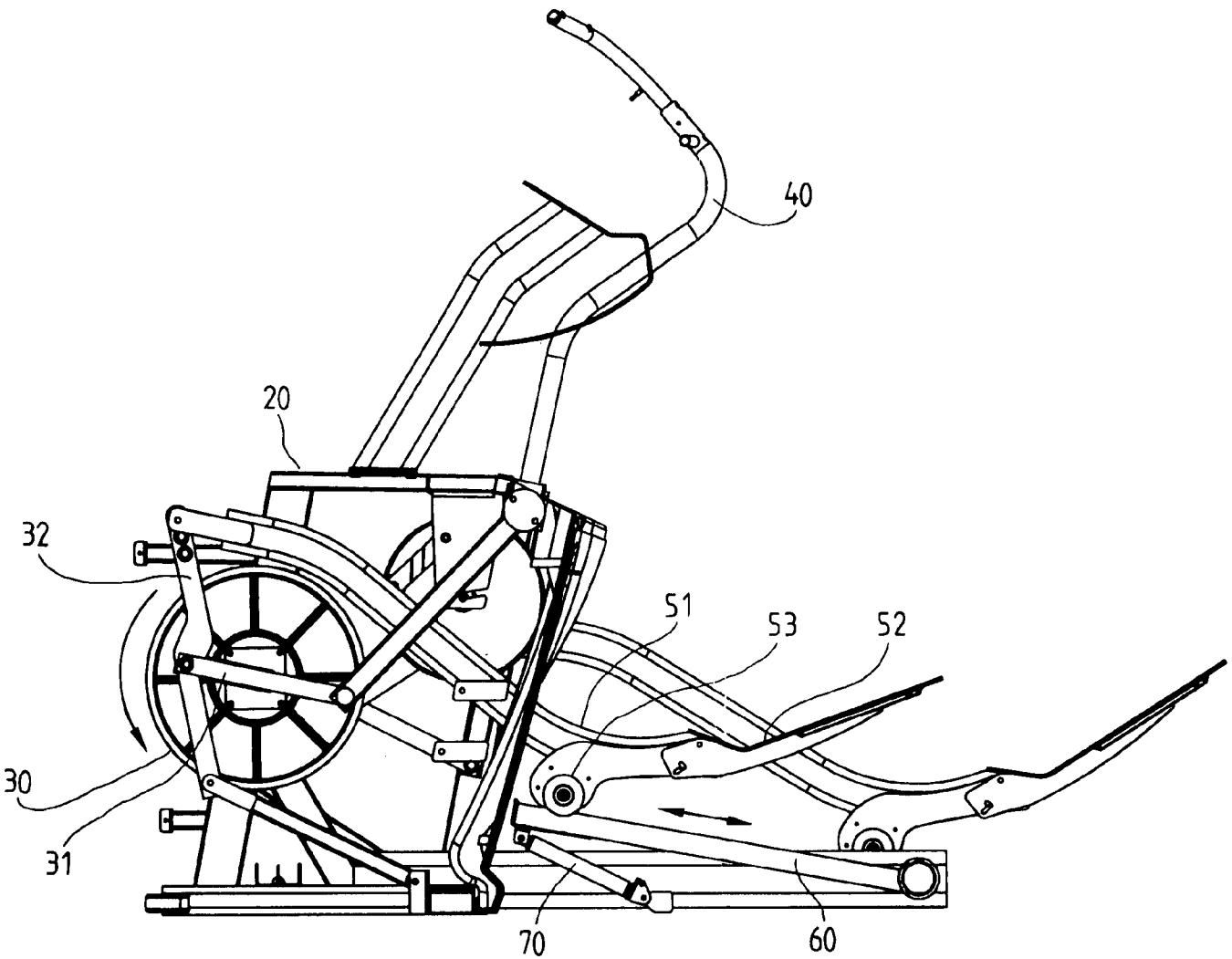
FIG. 9 is shows the elliptical exerciser with the pedal assembly of the present invention.
Figure 10:
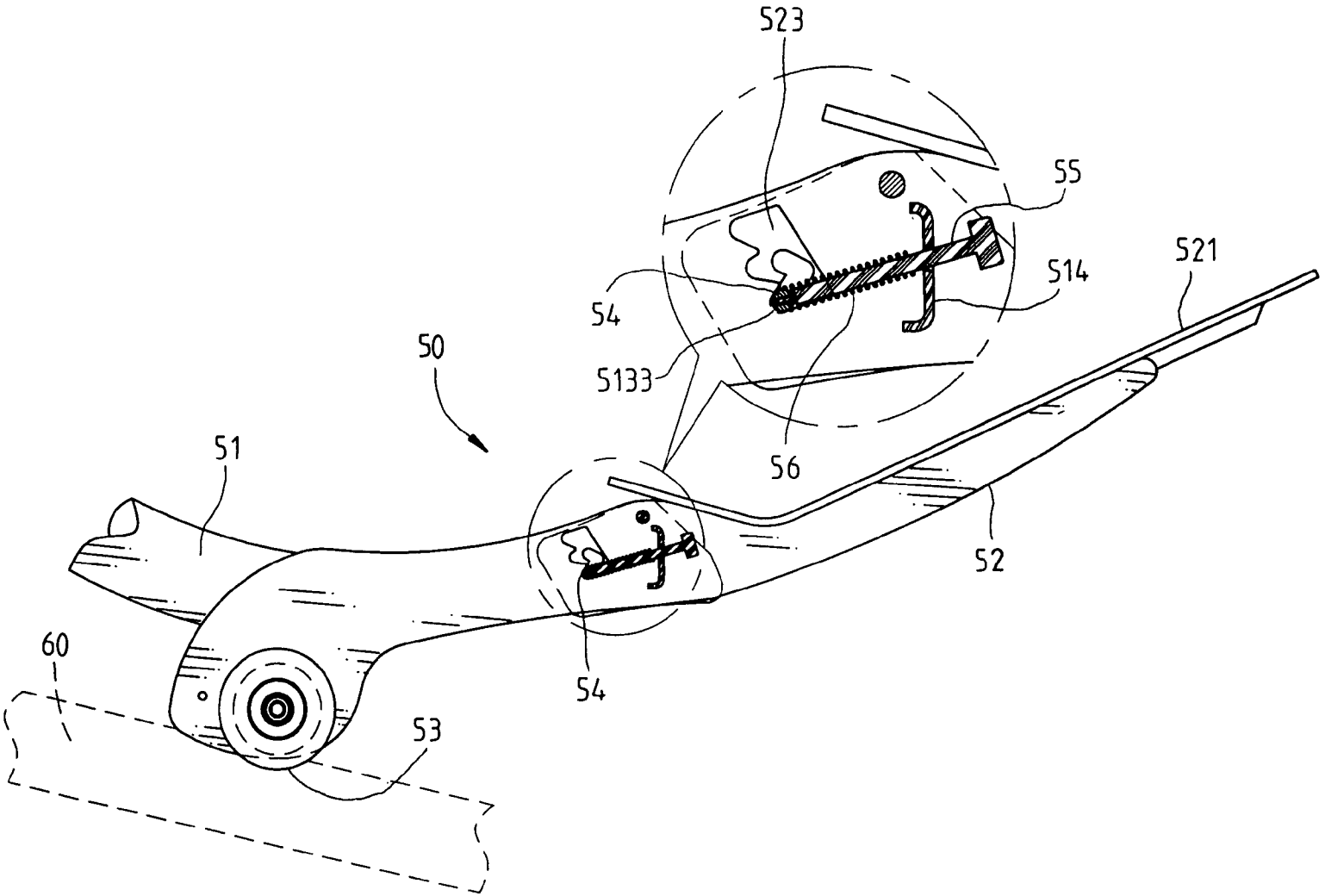
FIG. 10 shows the pin is engaged with the third notch in the hole of the pedal frame when the rails are positioned at the third position as shown in FIG. 9.

If the user wants to further lower the rails 60 as shown in FIGS. 9 and 10, the user pivots the pedals 52 counter clockwise and to remove the pin 54 from the second notch 5132 to the third notch 5133.

Figure 11:
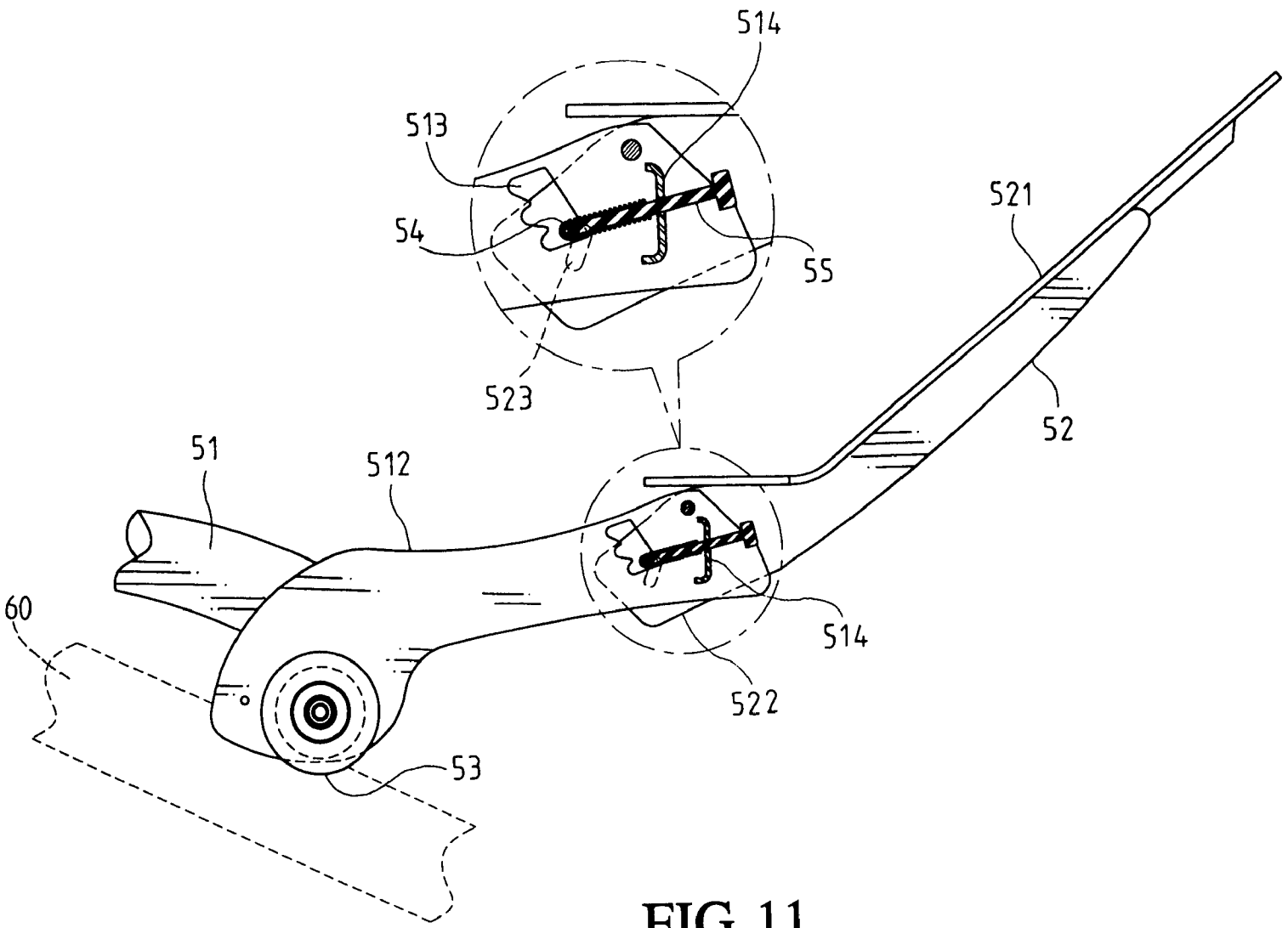
FIG. 11 shows the pin is disengaged from the notches and located in the reset slot.

FIG. 11 shows that when the user wants to remove the pin 54 from the third notch 5133 to another notch 5131 or 5132, the pedal 52 is pivoted counter clockwise to remove the pin 54 from the third notch 5133, the pin 54 is then slid into the reset slot 5232. The pedal 52 is then pivoted clockwise to let the pin 54 enter to one of the three notches 5131, 5132, 5133.

The angle adjustable pedals allow the user to comfortably step on the pedals with proper angle according to the adjustment of the rails.

While we have shown and described the embodiment in accordance with the present invention, it should be clear to those skilled in the art that further embodiments may be made without departing from the scope of the present invention.

What is claimed is:

1. An elliptical exerciser comprises a frame having a wheel connected thereto and a crank is connected to the wheel, each one of two ends of the crank having an extension link and the extension links located on two sides of the wheel, a mediate portion of a connection bar pivotably connected to an end of each of the extension links and the other end of each of the extension links connected to an end of a handle, an end of each of the connection bars pivotably connected to a link which is pivotably connected to the frame, two rails having an end pivotably connected to the frame, the other end of each of the rails connected to a lifting device, a pedal assembly that includes:

a pedal frame having a first end pivotably connected to the other end of each of the connection bars and a second end of the pedal frame having two side walls and an end plate connected between the two side walls, each side wall having a hole and three notches defined in an inside of the hole, at least one roller connected to the pedal frame and movably engaged to the rail, and a pedal having two connection plates which are pivotably connected to the two side walls, each connection plate having a set slot and a reset slot defined therethrough, the set slot and the reset slot communicating with each other and an angle defined between two axes of the set slot and the reset slot, a pin extending through one of the set slot and the reset slot and the hole, a bolt extending through the end plate and fixedly connected to a mediate portion of the pin, a spring mounted to the bolt and biased between the pin and the end plate wherein the pedals may be angularly adjustable relative to the pedal frames.

* * * * *

UNITED STATES PATENT AND TRADEMARK OFFICE

CERTIFICATE OF CORRECTION

PATENT NO. : 7,037,242 B2
APPLICATION NO. : 10/611971
DATED : May 2, 2006
INVENTOR(S) : Eric Lo et al.

It is certified that error appears in the above-identified patent and that said Letters Patent is hereby corrected as shown below:

| | |
|---|---|
| Column 3, Line 24 | Deleted "comprises" and insert --comprising-- |
| Column 4, Line 7 | After "device," insert --and-- |

Signed and Sealed this

Twenty-sixth Day of December, 2006

JON W. DUDAS
*Director of the United States Patent and Trademark Office*